US010160204B2

(12) United States Patent
Mori et al.

(10) Patent No.: US 10,160,204 B2
(45) Date of Patent: Dec. 25, 2018

(54) LIQUID EJECTION HEAD

(71) Applicant: CANON KABUSHIKI KAISHA, Tokyo (JP)

(72) Inventors: Tatsurou Mori, Yokohama (JP); Shuzo Iwanaga, Kawasaki (JP); Seiichiro Karita, Saitama (JP); Kazuhiro Yamada, Yokohama (JP); Akio Saito, Machida (JP); Zentaro Tamenaga, Sagamihara (JP); Shingo Okushima, Kawasaki (JP); Yumi Komamiya, Kawasaki (JP); Noriyasu Nagai, Tokyo (JP); Takatsuna Aoki, Yokohama (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/590,831

(22) Filed: May 9, 2017

(65) Prior Publication Data

US 2017/0334191 A1 Nov. 23, 2017

(30) Foreign Application Priority Data

May 23, 2016 (JP) ..... 2016-102813

(51) Int. Cl.
*B41J 2/14* (2006.01)
*B41J 2/045* (2006.01)
(Continued)

(52) U.S. Cl.
CPC ..... *B41J 2/0458* (2013.01); *B41J 2/03* (2013.01); *B41J 2/14096* (2013.01);
(Continued)

(58) Field of Classification Search
CPC .... B41J 2/175; B41J 2/14233; B41J 2/14201; B41J 2/1433; B41J 2/14032;
(Continued)

(56) References Cited

U.S. PATENT DOCUMENTS 6,350,013 B1 2/2002 Scheffelin
2011/0316918 A1* 12/2011 Nagashima ..... B41J 2/14233 347/12

(Continued)

*Primary Examiner* — Geoffrey S Mruk
*Assistant Examiner* — Scott A Richmond
(74) *Attorney, Agent, or Firm* — Canon U.S.A., Inc. IP Division

(57) ABSTRACT

A liquid ejection head includes a support member extending in a first direction, a print element board having an ejection port through which liquid is ejected, and first and second members arranged in the support member adjacent to each other along the first direction, each having a supply path extending in the first direction. The print element board element generates energy used for ejection of the supply paths supplied liquid. The first member includes an outlet port through which the supplied liquid flows out. The second member includes an inlet port through which the liquid from the outlet port flows. The outlet port is provided near a first member supply path end portion on the support member side on which the second member is provided. The inlet port is provided near a second member supply path end portion on the support member side on which the first member is provided.

5 Claims, 10 Drawing Sheets

(51) Int. Cl.

| | |
|---|---|
| ***B41J 2/03*** | (2006.01) |
| ***B41J 2/155*** | (2006.01) |
| *B41J 2/01* | (2006.01) |
| *B41J 2/07* | (2006.01) |
| *B41J 2/02* | (2006.01) |

(52) U.S. Cl.
CPC ..... *B41J 2/14145* (2013.01); *B41J 2/155* (2013.01); *B41J 2/01* (2013.01); *B41J 2/072* (2013.01); *B41J 2/14056* (2013.01); *B41J 2002/022* (2013.01); *B41J 2002/033* (2013.01); *B41J 2002/14467* (2013.01); *B41J 2202/19* (2013.01); *B41J 2202/20* (2013.01)

(58) Field of Classification Search
CPC .... B41J 2002/14362; B41J 2002/14306; B41J 2002/14419; B41J 2002/14467; B41J 2002/14459; B41J 2002/14483
See application file for complete search history.

(56) References Cited

U.S. PATENT DOCUMENTS

2016/0250854 A1* 9/2016 Nojo ..... B41J 2/14
347/50
2017/0096004 A1* 4/2017 Dowell ..... B41J 2/1433

* cited by examiner

LIQUID EJECTION HEAD

BACKGROUND OF THE INVENTION

Field of the Invention

The disclosure relates to a liquid ejection head which ejects a liquid.

Description of the Related Art

Recently, inkjet printers have been used for wider purposes including home use, business use for business applications and "retail photography," etc., and industrial use for drawing electronic circuits or manufacturing panel displays, etc. A liquid ejection head of such an inkjet printer for business use, etc. needs to print at a high speed. Therefore, a full-line head (a page-wide head) which is a liquid ejection head having a width greater than that of a recording medium is proposed. U.S. Pat. No. 6,350,013 describes a full-line head in which head modules are mounted on a support member. A plurality of printing element boards is arranged on the head modules.

In a configuration in which ink is supplied from an inlet port formed at a central portion of each head module as described in U.S. Pat. No. 6,350,013, flows of a liquid supplied to each head module move in directions toward both ends from the central portion of the head module. In this case, ink droplets to be ejected may vary in volume due to a difference in temperature of the liquid between adjacent head modules, which may cause print unevenness (density unevenness) at overlap portions of the head modules.

SUMMARY OF THE INVENTION

In an example, a liquid ejection head provides reduced density unevenness at overlap portions of head modules in a liquid ejection head having a plurality of head modules.

According to an aspect of the present invention, a liquid ejection head includes a support member extending in a first direction, first and second supply path members arranged in the support member adjacent to each other along the first direction, each of which has a supply path extending in the first direction, and a print element board having an element configured to generate energy used for ejection of a liquid supplied from the supply paths of the first and second supply path members, and further having an ejection port through which the liquid is ejected, wherein the first supply path member includes an outlet port through which the liquid supplied to the supply path of the first supply path member flows out of the first supply path member, wherein the second supply path member includes an inlet port through which the liquid which flowed out of the outlet port of the first supply path member flows into the supply path of the second supply path member, wherein the outlet port is provided near an end portion of the supply path of the first supply path member on the side of the support member on which the second supply path member is provided, and wherein the inlet port is provided near an end portion of the supply path of the second supply path member on the side of the support member on which the first supply path member is provided.

Further features of the present invention will become apparent from the following description of embodiments with reference to the attached drawings.

DESCRIPTION OF THE EMBODIMENTS

Hereinafter, a liquid ejection head according to embodiments is described with reference to the drawings. In each of the following embodiments, an inkjet recording head which ejects ink is described with reference to a specific configuration, but the embodiments are not limited to the same. An energy generating element employs thermal inkjet technology which generates air bubbles in a liquid with heat and ejects the liquid as an example in each embodiment. However, various other kinds of ejection technology, such as piezoelectric inkjet technology, may be employed.

The liquid ejection head is applicable to a printer, a copier, a facsimile machine having a communication system, an apparatus having a printer section, such as a word processor, and an industrial recording apparatus complexly combined with various processing apparatuses, etc. The embodiments also are applicable to manufacturing biochips and printing electronic circuits, etc. Since the embodiments described below are examples, they are subject to technically various limitations. However, the embodiments are not limited to neither the described embodiments of the specification, nor the other specific methods within the scope of the terms of the embodiments.

First Embodiment

Figure 1:
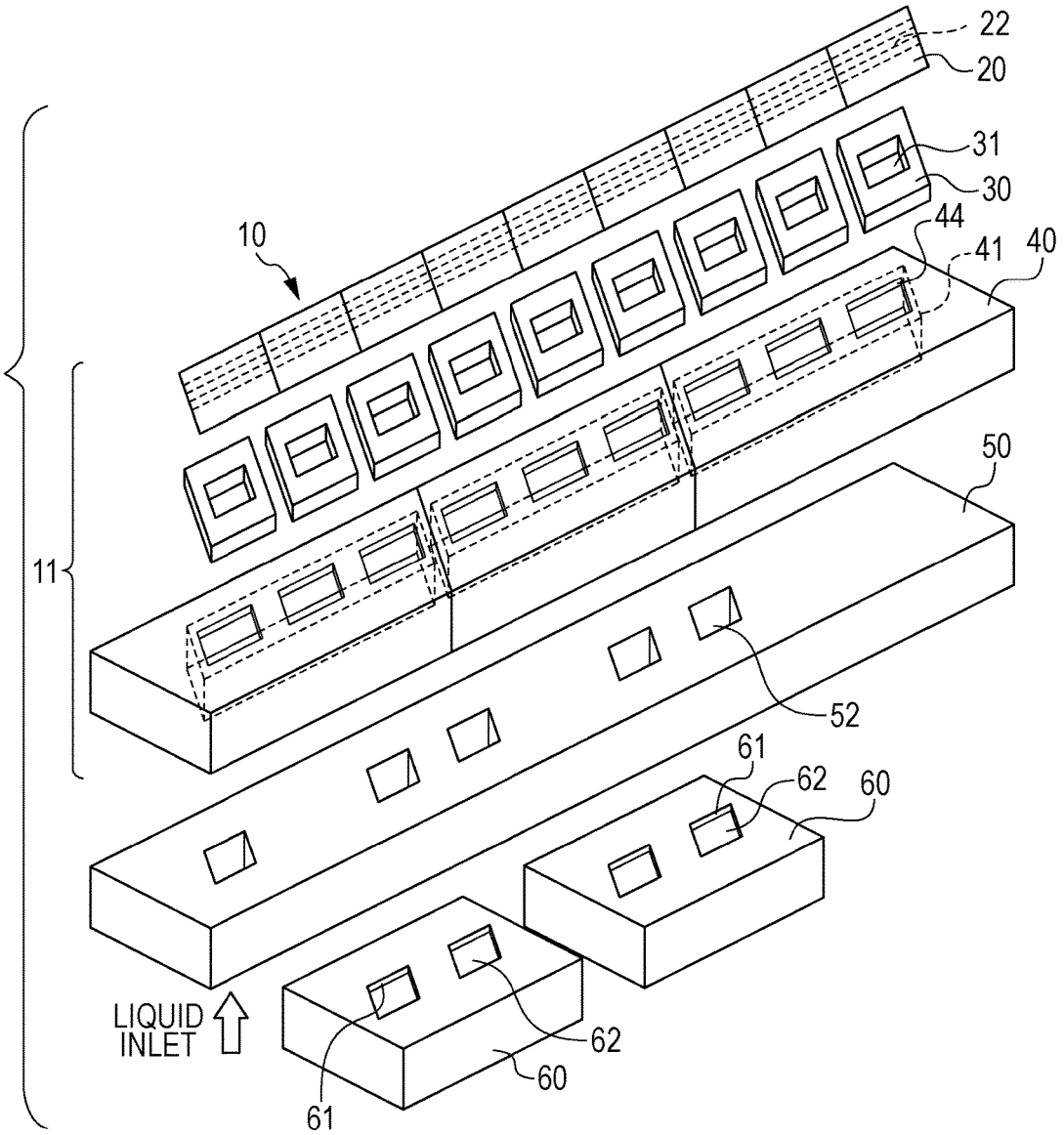
FIG. 1 is an exploded perspective view of a liquid ejection head according to a first embodiment.
Figure 2A:
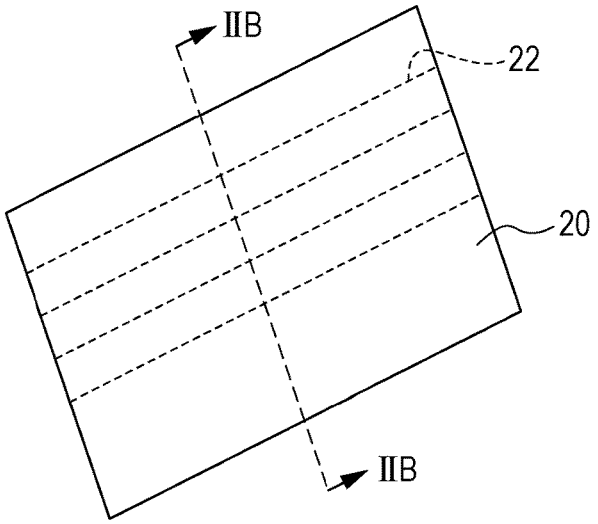
FIG. 2A is a schematic diagram of a print element board according to the first embodiment.
Figure 2B:
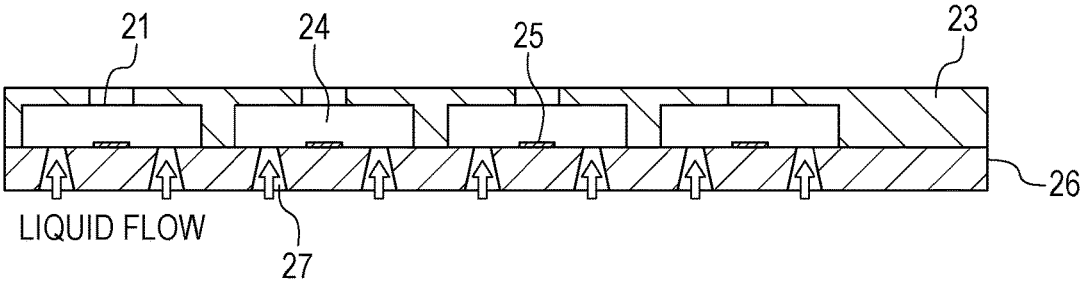
FIG. 2B is a cross-sectional view along line IIB-IIB of FIG. 2A.

A structure of a liquid ejection head according to a first embodiment is described. FIG. 1 is an exploded perspective view of a liquid ejection head 10 according to the present embodiment, FIG. 2A is a schematic diagram of print element boards 20 in FIG. 1, and FIG. 2B is a cross-sectional view along line IIB-IIB of FIG. 2A. For the ease of understanding of an internal structure, flexible printed circuits (FPC) electrically connected with electrodes formed in the print element boards 20 and a sealing member which seals an electrical connection portion of the print element boards 20 and the FPC are not illustrated in FIG. 1. As illustrated in FIG. 1, the liquid ejection head 10 includes a plurality of print element boards 20, distribution flow path members 30 which are flow path members supporting the print element boards 20, and supply path members 40 which support the distribution flow path members 30 and have supply paths 41 through which a liquid is supplied to the distribution flow path members 30. The liquid ejection head 10 includes a support member 50 which supports the supply path members 40, and connecting members 60. A plurality of through holes 52 through which the liquid is supplied is formed in the support member 50. In the supply path members 40, the supply paths 41 extending along the longitudinal direction of the support member 50, and openings 44 through which the liquid in the supply paths 41 is supplied to the flow path members 30 are formed. The supply path members 40 are disposed on one side of the support member 50, and the connecting members 60 are disposed on a back side, i.e., the other side of the support member 50. In the present embodiment, the print element boards 20, the distribution flow path members 30, and the supply path members 40 are collectively referred to as a head module 11.

The distribution flow path members 30 are disposed between the supply path members 40 and the print element boards 20. Each of the distribution flow path members 30 includes a flow path 31. A plurality of ejection port arrays 22 in which a plurality of ejection ports 21 is arranged is formed in the print element boards 20. The connecting members 60 connect the two adjacent supply path members 40 in fluid communication. In the connecting members 60, a plurality of connection ports 61, and connecting flow paths 62 through which the connection ports 61 communicate with each other are formed. As illustrated in FIG. 2B, each of the print element boards 20 is formed by a substrate 26 formed by Si and provided with elements 25 which generate energy used for ejecting a liquid, pressure chambers 24 in which the elements 25 are provided, and an ejection port forming member 23 provided with ejection ports 21. These are arranged in this order from below. The liquid supplied to the pressure chambers 24 via supply ports 27 formed in the substrate 26 is ejected to the outside as droplets through the ejection ports 21 when the elements 25 are driven.

Figure 3A:
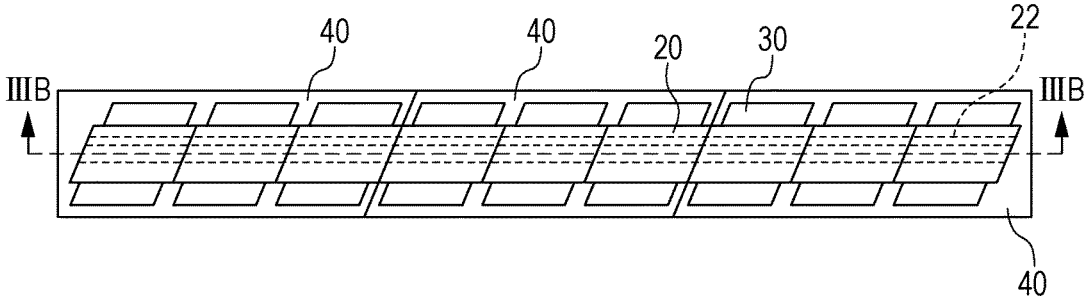
FIG. 3A is a top view of the liquid ejection head according to the first embodiment.
Figure 3B:
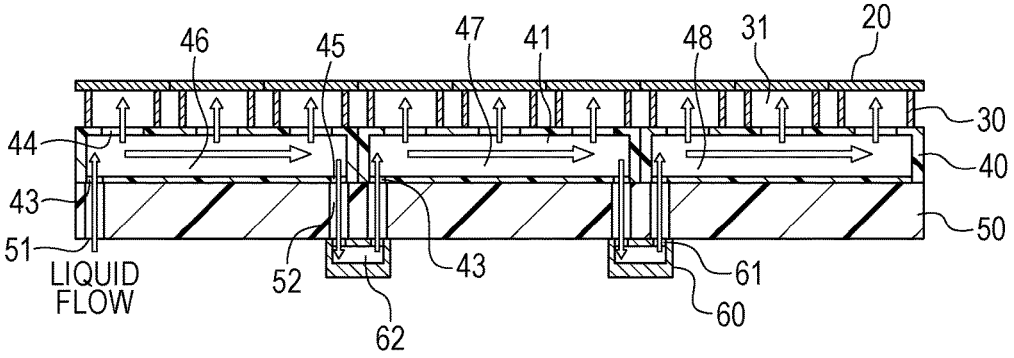
FIG. 3B is a cross sectional view along line IIIB-IIIB of FIG. 3A.
Figure 3C:
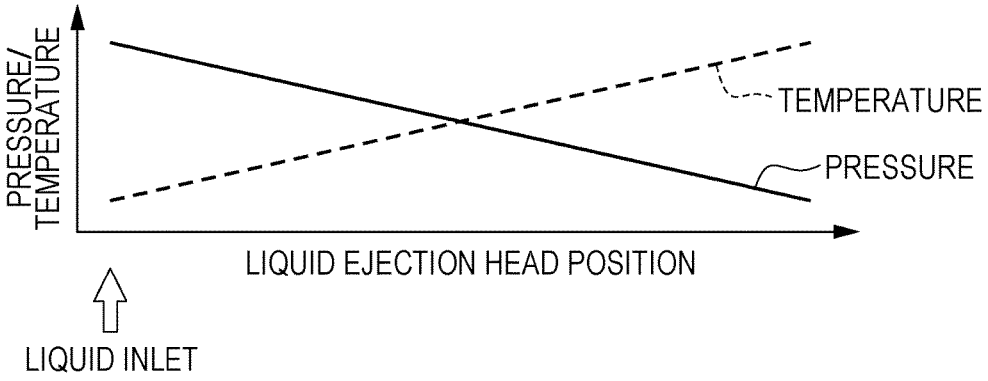
FIG. 3C is a schematic diagram illustrating distribution of pressure and temperature in the liquid ejection head according to the first embodiment.
Figure 4A:
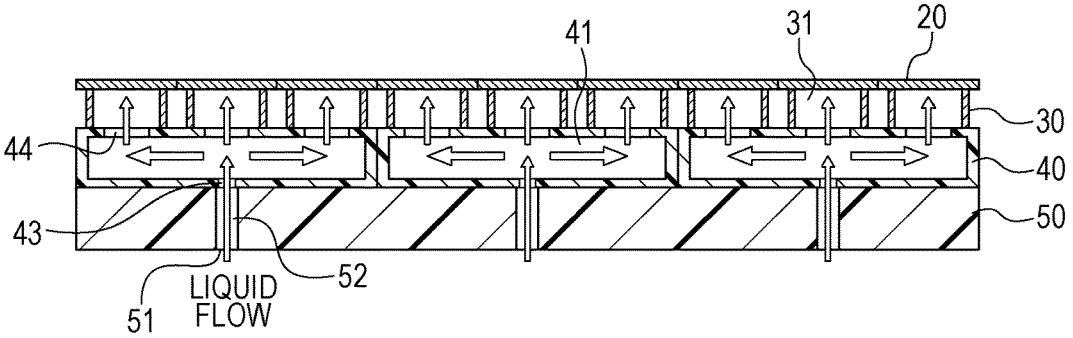
FIG. 4A is a cross-sectional view of a liquid ejection head as a Comparative Example.
Figure 4B:
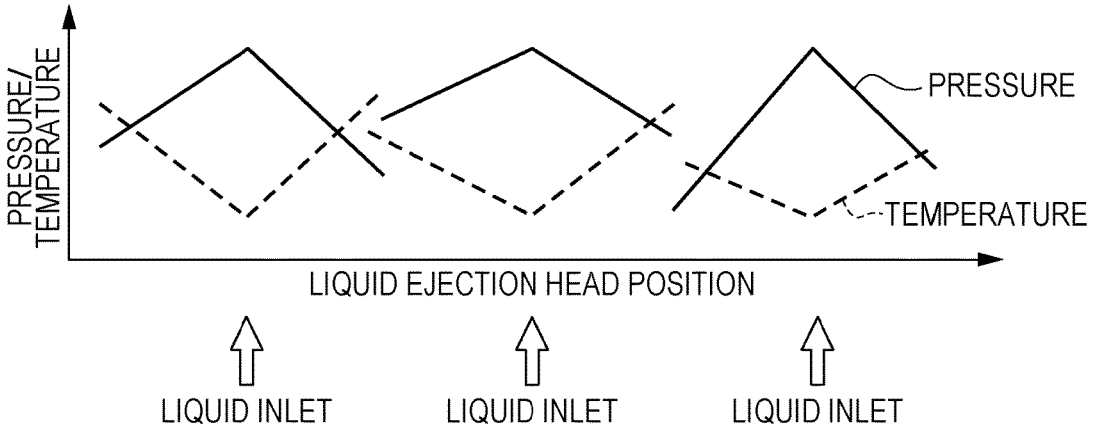
FIG. 4B is a schematic diagram illustrating distribution of pressure and temperature in the liquid ejection head as a Comparative Example.

FIG. 3A is a top view of the liquid ejection head 10 in FIG. 1. FIG. 3B is a cross-sectional view of the liquid ejection head 10 along line IIIB-IIIB of FIG. 3A. FIG. 3C is a schematic diagram illustrating distribution of pressure and temperature in the liquid ejection head 10 according to the first embodiment. FIG. 4A is a cross-sectional view of a liquid ejection head as a Comparative Example. FIG. 4B is a schematic diagram illustrating distribution of pressure and temperature in the liquid ejection head as a Comparative Example. A flow of a liquid in the liquid ejection head 10 of the present embodiment is described below.

A liquid, such as ink, supplied from an apparatus main body (not illustrated) on which the liquid ejection head 10 is mounted is supplied to the liquid ejection head 10 via a liquid inlet 51 provided in the support member 50. In the present embodiment, the liquid inlet 51 is formed at an end portion at a first end of the support member 50. The liquid which flowed into the liquid ejection head 10 from the liquid inlet 51 is supplied to the supply path members 40 through an inlet port 43 formed in each of the supply path members 40 via through holes 52 of the support member 50. The liquid supplied to the supply path members 40 is supplied to an outlet port 45 of each of the supply path members 40 via supply paths 41 extending along the longitudinal direction of the support member 50. In the present embodiment, the inlet port 43 is formed at an end portion at a first end of each supply path member 40, and the outlet port 45 is formed at an end portion at a second end opposite to the first side. The inlet port 43 and the outlet port 45 communicate with each other via the supply path 41. While the liquid is supplied to the inside of the supply path 41, temperature of the liquid increases gradually under the influence of the heat from the print element boards 20 disposed above the supply path 41. That is, as illustrated in FIG. 3C, the liquid which flowed in from the inlet port 43 is supplied to the outlet port 45 while temperature thereof increases gradually. The liquid in the supply path 41 is supplied to the distribution flow path members 30 which are flow path members via a plurality of openings 44 formed in the supply path member 40. The liquid is supplied to the supply ports 27 of the print element boards 20 via the flow path 31 formed in the distribution flow path members 30.

In the present embodiment, each supply path member 40 includes three members (a first supply path member 46, a second supply path member 47, and a third supply path member 48). As illustrated in FIG. 3B, the liquid supplied to the first supply path member 46 is partially supplied to the second supply path member 47 via the connecting member 60, and is further supplied to the third supply path member 48 via the connecting member 60. The liquid supplied from a first end to a second end of the first supply path member 46 is connected to the second supply path member 47 via the through hole 52 and the connecting member 60. The inlet port 43 of the second supply path member 47 is formed at an end portion on the side of the first supply path member 46. That is, the liquid is continuously supplied from the first supply path member 46 to the second supply path member 47, and there is substantially no change in temperature of the liquid when the liquid is supplied through the through hole 52 and the connecting member 60. Therefore, as illustrated in FIG. 3C, temperature of the liquid while the liquid is supplied from a first end to a second end of the liquid ejection head 10 changes continuously (linearly). Similarly, a change in pressure also changes continuously (linearly). Therefore, in the liquid ejection head consisting of a plurality of supply path members 40, recording unevenness (density unevenness) at overlap portions of the supply path members 40 can be avoided.

In the present embodiment, the support member 50 has enough rigidity that the liquid ejection head 10 does not bend. The distribution flow path members 30, the supply path members 40, and the support member 50 are to have sufficient corrosion resistance with respect to the liquid supplied, and are formed by materials with low linear expansion coefficients. For example, alumina and resin materials are suitably used as materials for the distribution flow path members 30, the supply path members 40, and the support member 50. Specifically, a composite material in which inorganic filler, such as silica particles, is added to a base material of a liquid crystal polymer (LCP), polyphenylenesulfide (PPS), and polysulfone (PSF) may be used suitably. The members disposed from below may be joined by adhesion with an adhesive, hot plate welding, screw clamping, or various other joint methods.

A plurality of print element boards 20, a plurality of distribution flow path members 30, and a plurality of supply path members 40 are arranged in series along the longitudinal direction of the support member 50. Adjacent print element boards 20 overlap each other and adjacent supply path members 40 overlap each other in the direction which perpendicularly crosses the longitudinal direction of the liquid ejection head 10. By setting a width of the liquid ejection head 10 to be equal to or greater than a width of the recording medium onto which recording is performed, a full-line (a page-wide) liquid ejection head is provided. A plurality of print element boards 20 may be arranged so that the ejection port arrays 22 are inclined with respect to the longitudinal direction of the support member 50. In this case, a plurality of print element boards 20 is arranged so that the centroid position of each print element board 20 is disposed in parallel with the longitudinal direction of the support member 50.

Although the supply paths 41 formed inside of adjacent supply path members 40 communicate with each other via the connecting member 60 in the present embodiment, the embodiments are not limited to the same. A configuration also is applicable to a case where connection ports are formed at both end surfaces in the longitudinal direction of adjacent supply path members 40 so that adjacent supply paths 41 communicate with each other directly, for example. Although the liquid which flowed from the liquid inlet 51 is linearly and horizontally supplied from the first end to the second end in the longitudinal direction of the liquid ejection head 10, the embodiments are not limited to the same. A configuration is applicable to a case where the supply paths 41 extending in the longitudinal direction of the liquid ejection head 10 are inclined with respect to the vertical direction or the supply paths 41 are inclined with respect to the width direction of the liquid ejection head 10, for example.

Embodiments also are to a configuration in which the print element boards are arranged in a staggered pattern instead of an in-line (linear) pattern as illustrated in FIG. 3A. In this case, the supply paths 41 provided in the supply path member 40 are formed as flow paths with bending portions. Embodiments also are applicable to a configuration in which a liquid outlet is formed inside of the support member 50 to communicate with an end portion in the longitudinal direction of the supply path 41 so that a liquid circulates in the liquid ejection head 10. In an example of circulation structure, a supply path for collecting liquid is provided separately from the supply paths 41 in FIG. 3B in parallel with the supply paths 41, and a pressure difference is provided between the supply paths 41 and the supply path for collecting liquid to allow circulation. With this configuration, a path in which a liquid supplied to the pressure chamber 24 of each print element board 20 from the supply path 41 is collected to the supply path for collection via the pressure chamber 24 is formed. That is, the liquid in the pressure chamber 24 can be circulated between the pressure chamber 24 and the outside of the pressure chamber 24.

In the present embodiment, as illustrated in FIG. 2A, four ejection port arrays 22 are formed in the print element board 20. The four ejection port arrays may eject different types of ink, or may eject ink of the same color. The print element board 20 is parallelogrammatic in outer shape as illustrated in FIGS. 1 and 2A in terms of space saving and providing a small-sized liquid ejection head 10. However, the print element board 20 may be various other shapes, such as rectangular, trapezoidal, etc.

Next, a liquid ejection head as a Comparative Example is described with reference to FIGS. 4A and 4B. As illustrated in FIG. 4A, in the liquid ejection head of Comparative Example, an inlet port 43 of a supply path member 40 is formed at a central portion of a supply path 41. In this case, a liquid which flowed into each supply path member 40 is supplied toward both ends of the supply path 41. At that time, temperature of the liquid increases under the influence of heat from print element boards 20. As illustrated in FIG. 4B, the liquids which flowed into different supply path members 40 increase in temperature at different degrees while being supplied to the end portions. The different degrees of increase in temperature are influenced by a difference in driving frequency of elements in each print element board 20, etc. Therefore, a liquid at an end portion of a first supply path member 46 and a liquid at an end portion of a second supply path member 47 are different in temperature. That is, temperature of a liquid at an overlap portion between a first supply path member and a second supply path member changes not continuously but intermittently. Therefore, an amount of droplets ejected from the print element boards 20 varies, which causes density unevenness. On the contrary, in the configuration of the liquid ejection head 10 in the first embodiment, as illustrated in FIG. 3C, although a difference in temperature of a liquid occurs, since a temperature changes continuously at an overlap portion of the supply path members, density unevenness is less notable.

Second Embodiment

Figure 5:
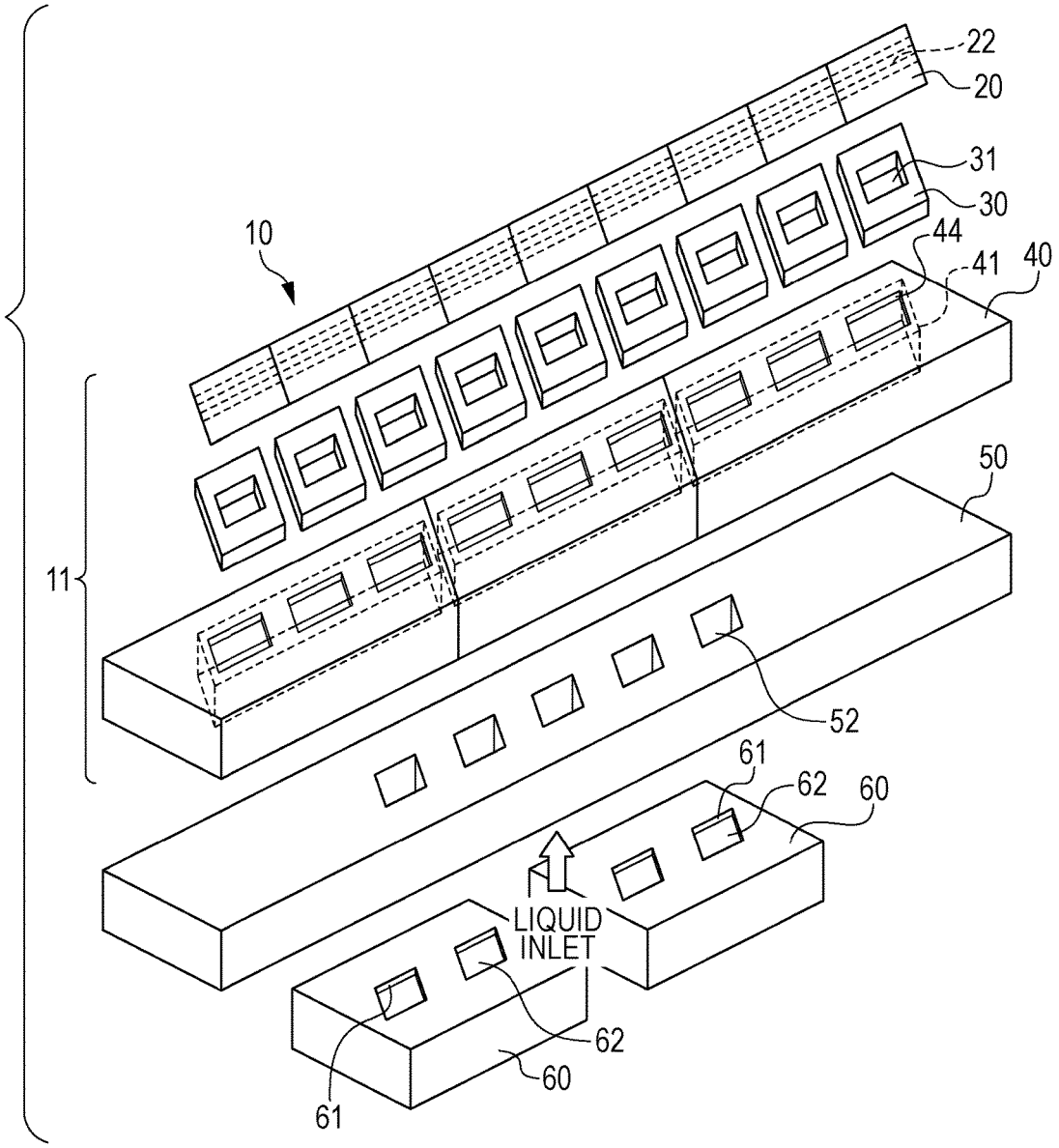
FIG. 5 is an exploded perspective view of a liquid ejection head according to a second embodiment.
Figure 6A:
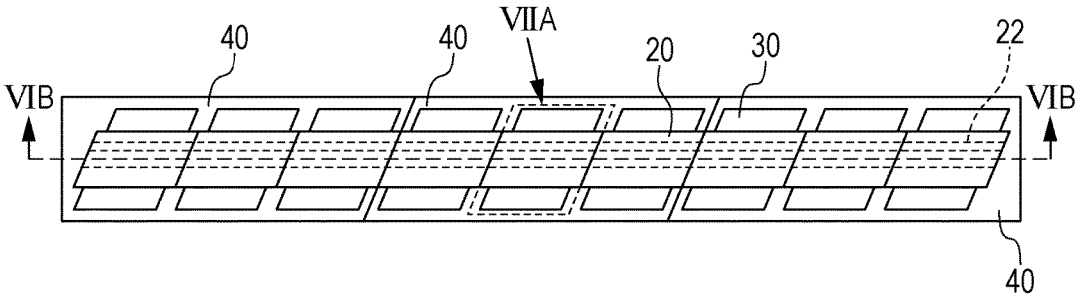
FIG. 6A is a top view of the liquid ejection head according to the second embodiment.
Figure 6B:
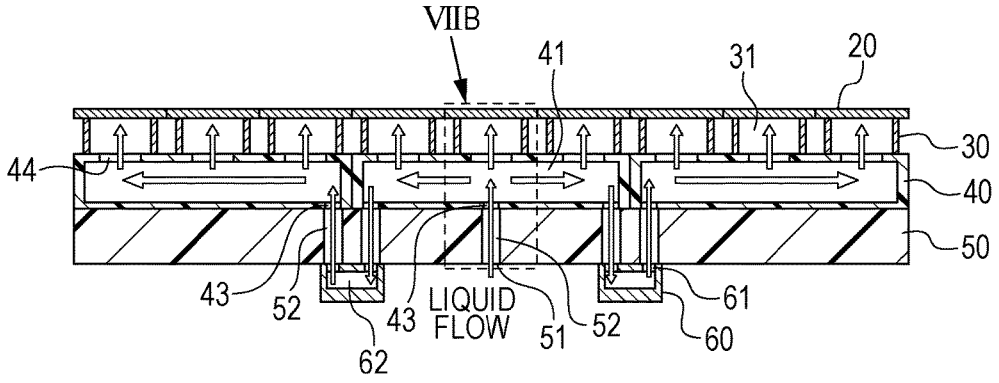
FIG. 6B is a cross-sectional view along line VIB-VIB of FIG. 6A.
Figure 6C:
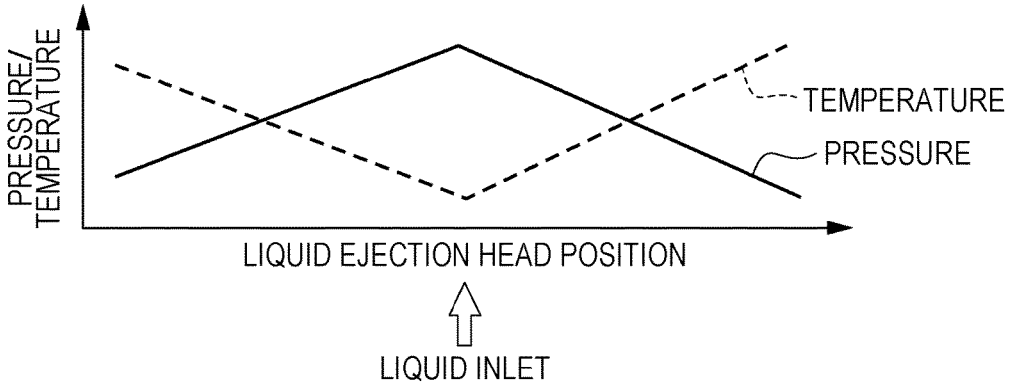
FIG. 6C is a schematic diagram illustrating distribution of pressure and temperature in the liquid ejection head according to the second embodiment.
Figure 7A:
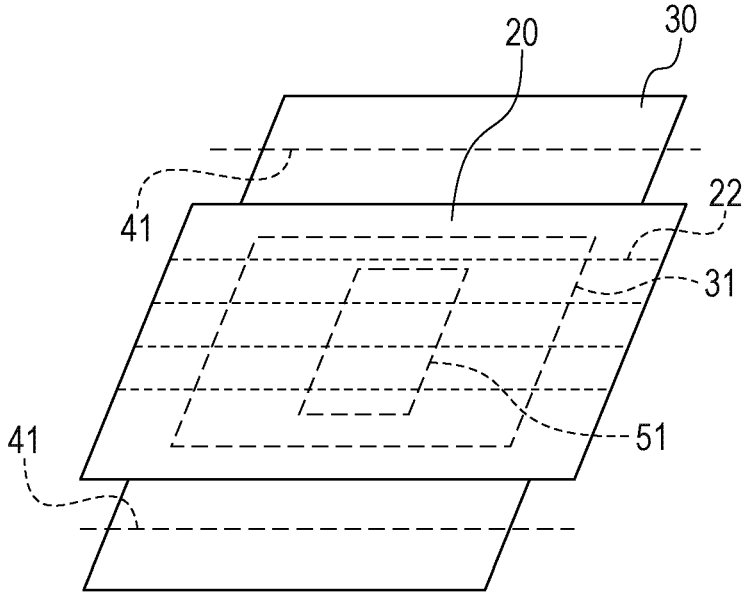
FIG. 7A is a partially enlarged view of FIG. 6A.
Figure 7B:
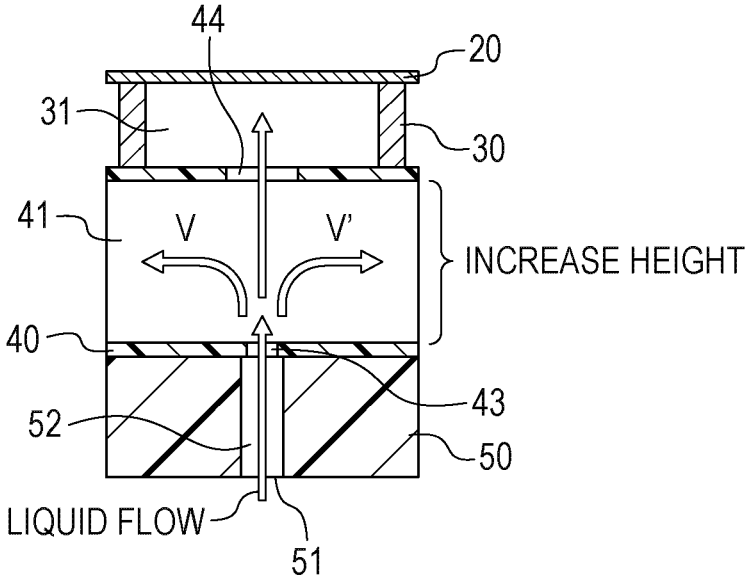
FIG. 7B is a partially enlarged view of FIG. 6B.

A structure of a liquid ejection head according to a second embodiment is described. FIG. 5 is an exploded perspective view of the liquid ejection head according to the second embodiment. FIG. 6A is a top view of the liquid ejection head in FIG. 5. FIG. 6B is a cross-sectional view of the liquid ejection head along line VIB-VIB of FIG. 5A. FIG. 6C is a schematic diagram illustrating distribution of pressure and temperature in the liquid ejection head according to the second embodiment. FIG. 7A is an enlarged view of a portion VIIA in FIG. 6A. FIG. 7B is an enlarged view of a portion VIIB in FIG. 6B.

A configuration of a liquid ejection head 10 according to the second embodiment differs from the configuration of the first embodiment in that a liquid inlet 51 is formed at a central portion in the longitudinal direction of a support member 50 instead of an end portion in the longitudinal direction of the support member 50. The liquid which flowed from the liquid inlet 51 formed at the central portion in the longitudinal direction of the support member 50 passes a through hole 52, an inlet port 43, a supply path 41, openings 44, and flow paths 31 in this order, and is supplied to print element boards 20. Besides this flow, the liquid which flowed from the liquid inlet 51 passes the through hole 52, inlet ports 43, supply paths 41, connection ports 61, and connecting flow paths 62 in this order, is supplied to adjacent supply path members 40, and is supplied sequentially to both ends in the longitudinal direction of the liquid ejection head 10. Also in the present embodiment, as in the first embodiment, by continuously supplying a liquid across adjacent head modules 11 via the connecting members 60, differences in pressure and temperature of the liquid between adjacent head modules 11 can be reduced.

Also in a case where the number of the head modules 11 is increased to further increase the length of the liquid ejection head 10, the number of portions at which differences in pressure and temperature of the liquid between adjacent head modules 11 occur can be reduced. Therefore, print unevenness at an overlap portion of the head modules 11 can be reduced. Since print unevenness changes continuously and stepwise from the central portion in the longitudinal direction of the liquid ejection head 10 toward both ends in the longitudinal direction of the liquid ejection head 10 (i.e., print density continuously increases), print unevenness is less easily visible. By supplying a liquid from the central portion in the longitudinal direction of the liquid ejection head 10 toward both ends in the longitudinal direction of the liquid ejection head 10, a length of a common flow path becomes shorter as compared with a case where the liquid is supplied from a first end toward a second end of the liquid ejection head 10. Since a length of the common flow path from the uppermost stream part to the lowermost stream part of a flow of the liquid in the longitudinal direction of the liquid ejection head 10 becomes shorter, differences in pressure and temperature between the endmost parts in the longitudinal direction of the liquid ejection head 10 become smaller. Then, an image of high quality can be formed.

In the liquid ejection head 10 according to the second embodiment, the liquid is supplied from the central portion in the longitudinal direction of the liquid ejection head 10. Therefore, a pressure wave of the liquid flowing in from the liquid inlet 51 may propagate to the print element boards 20 via the supply paths 41. To avoid this, as illustrated in FIG. 7B, flows of the liquid in the directions of V and V' can be enhanced by increasing the height of the supply paths 41 formed inside of the supply path members 40. Specifically, as expressed by Expression (1), the effect becomes especially significant when the height of the supply paths 41 is set to be larger than an equivalent diameter (an opening diameter) d of the through hole 52 which communicates with the supply path 41. Therefore, a flow of the liquid flowing toward the flow path 31 can be reduced, and propagation of the pressure wave of the liquid flowing in from the liquid inlet 51 to the print element boards 20 can be prevented. If the print element boards 20 are arranged in a staggered pattern along the longitudinal direction of the liquid ejection head 10, the liquid inlet 51 can be formed in the support member 50 directly below a portion at which no print element boards 20 is provided. Therefore, propagation of the pressure wave of the liquid flowing in from the liquid inlet 51 to the print element boards 20 can be avoided.

$$d=4a/w \qquad \text{Expression (1)}$$

In Expression (1), d denotes an equivalent diameter, a denotes a cross-sectional area of the flow path, and w denotes a wetted perimeter length.

Third Embodiment

Figure 8:
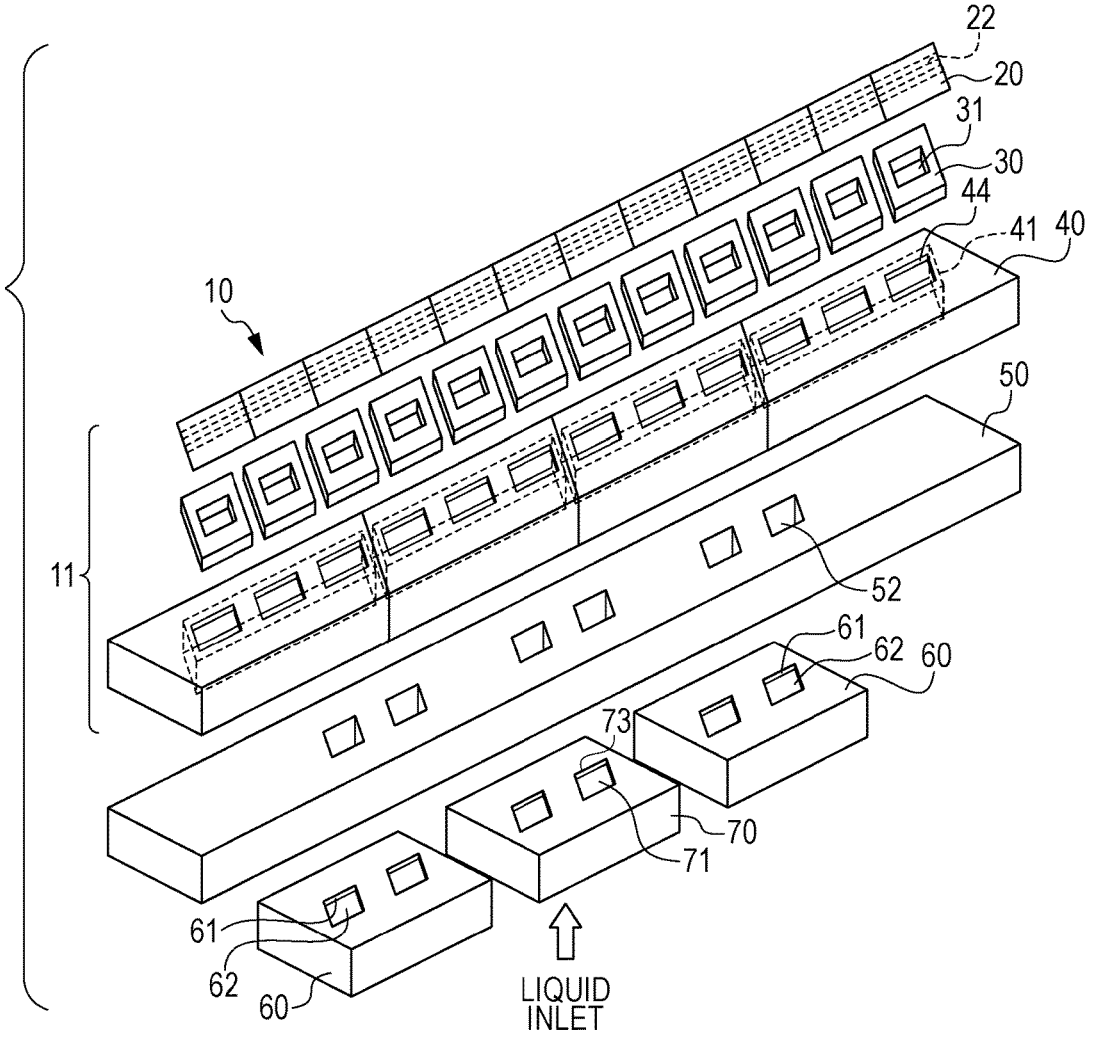
FIG. 8 is an exploded perspective view of a liquid ejection head according to a third embodiment.
Figure 9A:
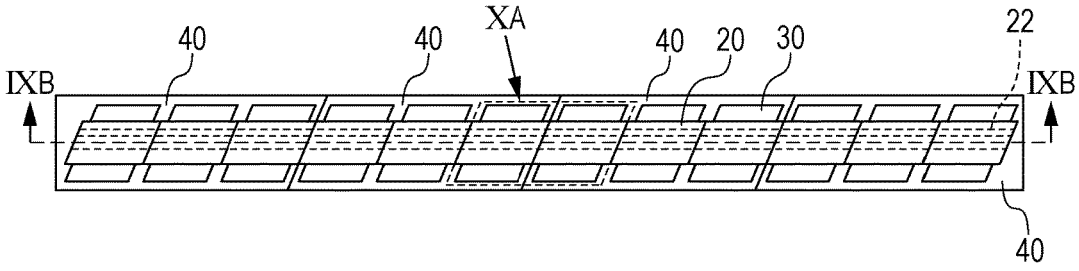
FIG. 9A is a top view of the liquid ejection head according to the third embodiment.
Figure 9B:
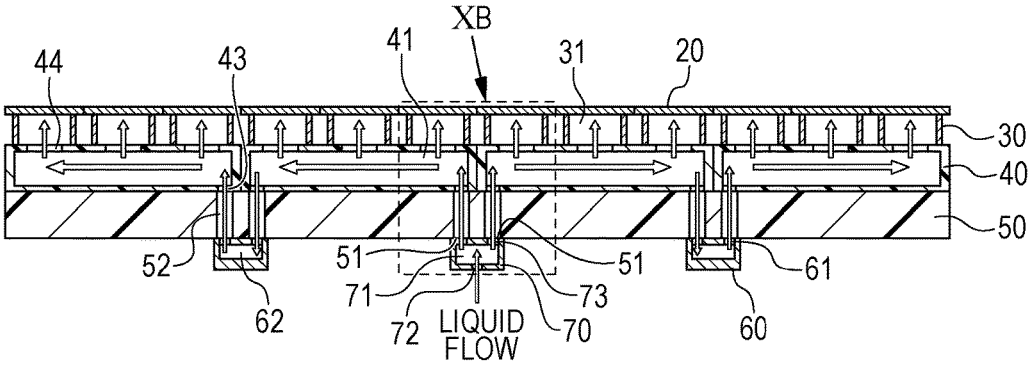
FIG. 9B is a cross-sectional view along line IXB-IXB of FIG. 9A.
Figure 9C:
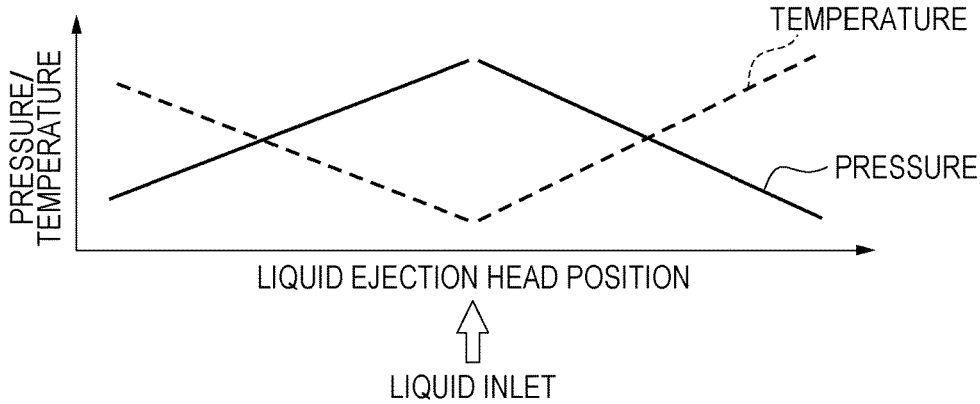
FIG. 9C is a schematic diagram illustrating distribution of pressure and temperature in the liquid ejection head according to the third embodiment.
Figure 10A:
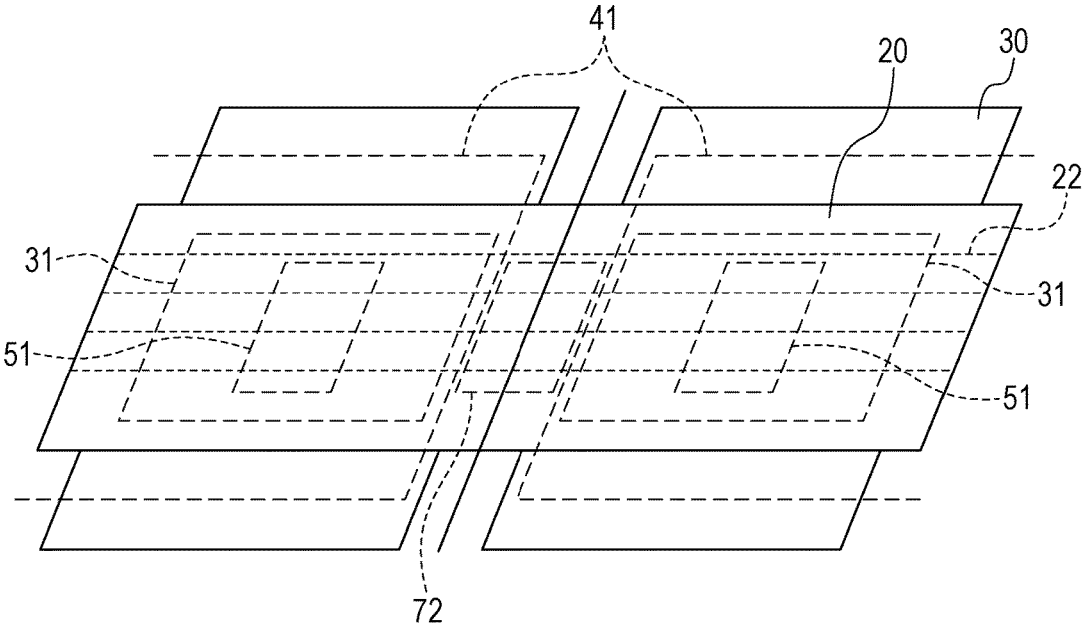
FIG. 10A is a partially enlarged view of FIG. 9A.
Figure 10B:
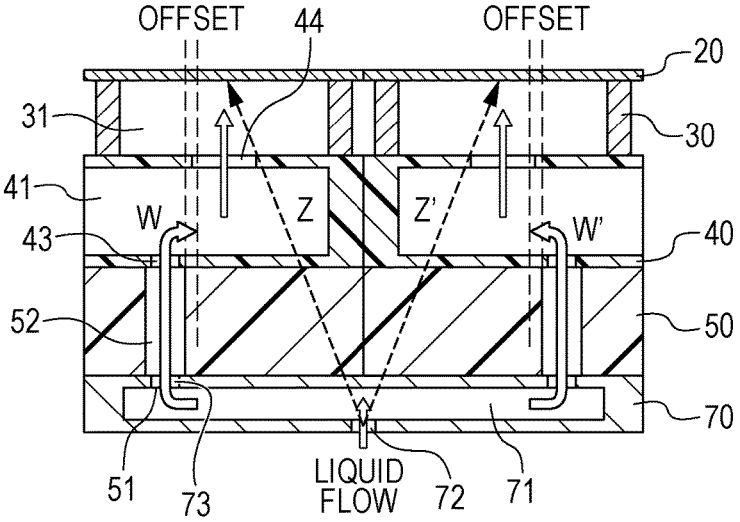
FIG. 10B is a partially enlarged view of FIG. 9B.

A structure of a liquid ejection head according to a third embodiment is described. FIG. 8 is an exploded perspective view of the liquid ejection head according to the third embodiment. FIG. 9A is a top view of the liquid ejection head in FIG. 8. FIG. 9B is a cross-sectional view of the liquid ejection head along line IXB-IXB in FIG. 8A. FIG. 9C is a schematic diagram illustrating distribution of pressure and temperature in the liquid ejection head according to the third embodiment. FIG. 10A is an enlarged view of a portion XA of FIG. 9A. FIG. 10B is an enlarged view of a portion XB of FIG. 9B.

A configuration of a liquid ejection head 10 according to the third embodiment differs from that of the second embodiment in that two liquid inlets 51 are formed only at a central portion in the longitudinal direction of the support member 50. This is because an even number of head modules 11 are arranged in the longitudinal directions of the support member 50. Also in the present embodiment, by supplying a liquid across adjacent head modules 11 via the connecting members 60, differences in pressure and temperature of the liquid between adjacent head modules 11 can be reduced. At the central portion in the longitudinal direction of the support member 50, since the liquid of substantially the same pressure and temperature flows in from the two liquid inlets 51, differences in pressure and temperature between adjacent head modules 11 can be made significantly smaller at the central portion in the longitudinal direction of the support member 50. Therefore, print unevenness at an overlap portion of the head modules 11 can be reduced significantly. In addition, since the configuration of the liquid ejection head 10 is axial symmetrical about a central portion in the longitudinal direction of the liquid ejection head 10 toward both the ends of the liquid ejection head 10, components can be used in common and a mounting process of the liquid ejection head 10 can be simplified.

In the liquid ejection head 10 according to the third embodiment, a liquid is supplied from a central portion in the longitudinal direction of the liquid ejection head 10. Therefore, a pressure wave of the liquid which passes a liquid inlet 72, a connecting flow path 71, and connection ports 73, and flows in from the liquid inlets 51 may propagate to print element boards 20 via supply paths 41. This may vibrate meniscuses formed in ejection ports 21 by the liquid, and stable ejection may become impossible. To avoid this, as illustrated in FIG. 10B, the through holes 52 and openings 44 are offset from each other when seen from a direction in which a liquid is ejected from the ejection ports 21. That is, the direction of the flow of the liquid toward the print element boards 20 from the liquid inlet 72 is set as follows. Positions of the through holes 52 formed inside of the support member 50 and the openings 44 formed inside of the supply path member 40 are offset so as not overlap each other in the vertical direction of the liquid ejection head 10. Since the liquid flows in bending directions as illustrated by W and W' from the liquid inlet 72 toward the print element boards 20, propagation of the pressure wave of the liquid flowing in from the liquid inlet 72 to the print element boards 20 can be prevented. If the print element boards 20 are arranged in a staggered pattern in the longitudinal direction of the liquid ejection head 10, the liquid inlet 72 can be formed in the connecting member 70 directly below a portion at which no print element boards 20 is provided. Therefore, propagation of the pressure wave of the liquid flowing in from the liquid inlet 72 to the print element boards 20 can be prevented.

According to an embodiment, density unevenness at overlap portions of head modules in a liquid ejection head having a plurality of head modules can be reduced.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-102813 filed May 23, 2016, which is hereby incorporated by reference herein in its entirety.

What is claimed is:

1. A liquid ejection head comprising:

a support member extending in a first direction;

first and second supply path members arranged in the support member adjacent to each other along the first direction, each of which has a supply path extending in the first direction; and a print element board having an element configured to generate energy used for ejection of a liquid supplied from the supply paths of the first and second supply path members, and further having an ejection port through which the liquid is ejected, wherein the first supply path member includes an outlet port through which the liquid supplied to the supply path of the first supply path member flows out of the first supply path member, wherein the second supply path member includes an inlet port that receives liquid flowed out of the outlet port of the first supply path member and transmits the received liquid into the supply path of the second supply path member, wherein the outlet port is provided near an end portion of the supply path of the first supply path member on the side of the support member on which the second supply path member is provided, wherein the inlet port is provided near an end portion of the supply path of the second supply path member on the side of the support member on which the first supply path member is provided, and wherein the support member includes a first through hole communicating with the outlet port of the first supply path member, and a second through hole communicating with the inlet port of the second supply path member.

2. The liquid ejection head according to claim 1, further comprising a connecting member provided with a connecting member flow path for communicating the first through hole with the second through hole.

3. The liquid ejection head according to claim 2, wherein the first and second supply path members are provided on a first side of the support member, and the connecting member is provided on a back side of the first side.

4. The liquid ejection head according to claim 1, wherein a height of the supply path of the second supply path member is greater than an opening diameter of the second through hole.

5. A liquid ejection head comprising:

a support member extending in a first direction;

first and second supply path members arranged in the support member adjacent to each other along the first direction, each of which has a supply path extending in the first direction; and a print element board having an element configured to generate energy used for ejection of a liquid supplied from the supply paths of the first and second supply path members, and further having an ejection port through which the liquid is ejected, wherein the first supply path member includes an outlet port through which the liquid supplied to the supply path of the first supply path member flows out of the first supply path member, wherein the second supply path member includes an inlet port that receives liquid flowed out of the outlet port of the first supply path member and transmits the received liquid into the supply path of the second supply path member, wherein the outlet port is provided near an end portion of the supply path of the first supply path member on the side of the support member on which the second supply path member is provided, wherein the inlet port is provided near an end portion of the supply path of the second supply path member on the side of the support member on which the first supply path member is provided, and wherein a plurality of print element boards is arranged along the first direction in each of the first and second supply path members.

* * * * *